US005110009A

United States Patent [19]

Gartner et al.

[11] Patent Number: 5,110,009

[45] Date of Patent: May 5, 1992

[54] COIN ROLL DISPENSING MECHANISM

[75] Inventors: Klaus W. Gartner, Palos Verdes Estates, Calif.; Alan K. Uyeda, 8939 Gallatin Rd., #25, Pico Rivera, Calif. 90660

[73] Assignee: Alan K. Uyeda, Pico Rivera, Calif.

[21] Appl. No.: 781,841

[22] Filed: Oct. 23, 1991

Related U.S. Application Data

[63] Continuation of Ser. No. 547,486, Jul. 3, 1990, abandoned.

[51] Int. Cl.[5] ..... G07F 11/24

[52] U.S. Cl. ..... 221/266; 221/133; 221/152; 221/154

[58] Field of Search ..... 221/266, 152, 153, 129, 221/131, 133, 154, 98, 99, 100, 7, 8; 232/10 D, 15, 43.1, 64, 65, 66; 70/DIG. 63; 109/53

[56] References Cited

U.S. PATENT DOCUMENTS

| | | | |
|---|---|---|---|
| 2,311,632 | 2/1943 | Berger et al. | 221/266 X |
| 2,922,546 | 1/1960 | Trulaske | 221/152 X |
| 4,313,601 | 2/1982 | Graef et al. | 232/1 D X |
| 4,663,621 | 5/1987 | Field et al. | 221/154 X |
| 4,922,837 | 5/1990 | McGunn | 109/53 X |
| 4,927,055 | 5/1990 | Groover | 221/133 X |

FOREIGN PATENT DOCUMENTS 2217073 10/1989 United Kingdom .

*Primary Examiner*—Robert P. Olszewski
*Assistant Examiner*—Dean A. Reichard
*Attorney, Agent, or Firm*—Poms, Smith, Lande & Rose

[57] ABSTRACT

A coin roll dispensing mechanism for use in dispensing coin rolls from a safe, the mechanism includes a coin roll dispenser for selectively distributing individual coin rolls, electrically operated solenoids to prevent operation of the dispenser and a first electrically operated combination entry device to disengage the solenoids. The safe door has a door handle, a plurality of bolts, a bolt works to manipulate the bolts, and electronic lock to restrict manipulation of the bolt works and a second electrically operated combination entry device to disengage the electronic lock. Upon entry of a first code sequence, the user can select a coin roll to be dispensed. To unlock the safe, a second code sequence is entered, which disables the electronic lock, allowing manual manipulation of the door handle.

16 Claims, 3 Drawing Sheets

65
77
79
5
76
63
75
78
81
70
74
6
72
68
62
59
71
11
56
73

21
32
16
43
35
38
49
33
17
41
42
34
18
31
64
65a
65b
65c
65d
65e
65f
46
12
39
44
36
47
48
37
45
40
53
71a
71b
68
69
81
58
67
66
71c
77
54
60
70
71f
71e
71d
10
11

Fig. 7.
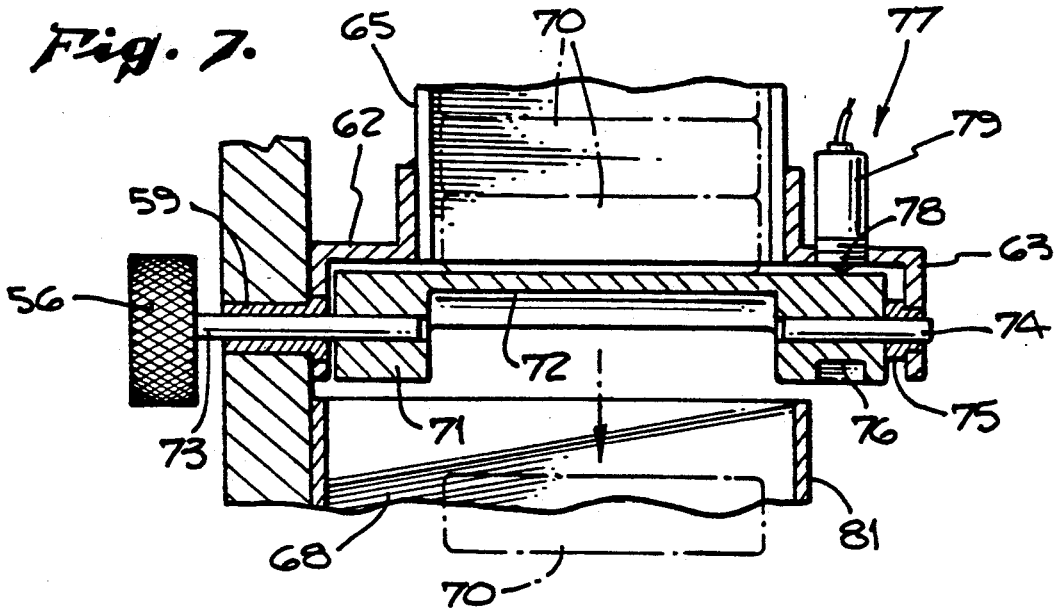
Fig. 5.
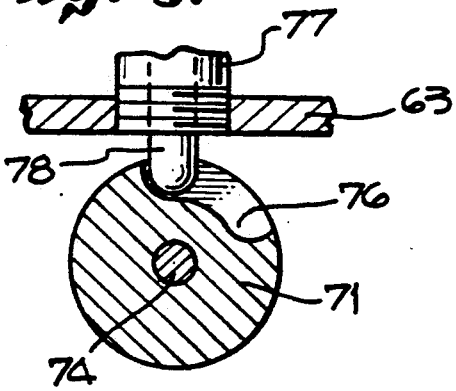
Fig. 8.
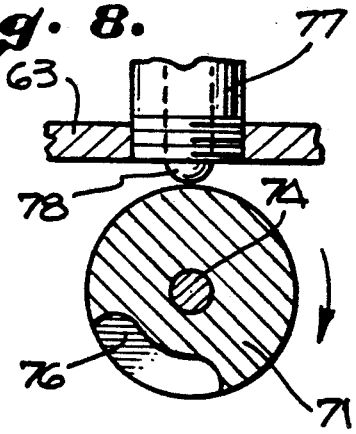
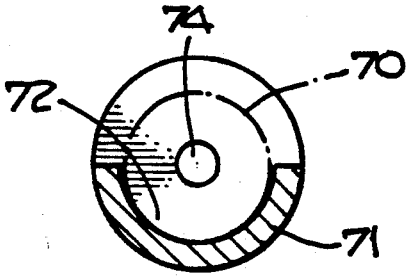
Fig. 6.
Fig. 9.
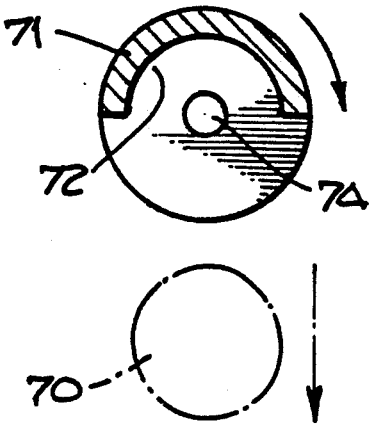

COIN ROLL DISPENSING MECHANISM

RELATED APPLICATION

This invention is a continuation of copending application Ser. No. 07/547,486, filed July 3, 1990, now abandoned.

INTRODUCTION

Generally stated, the present invention relates to the dispensing of coin rolls, and more particularly to a mechanism to dispense coin rolls from within a safe after entry of a coded sequence.

BACKGROUND OF THE INVENTION

Retail stores, banks and other business establishments frequently require an abundance of coins in order to provide correct change to their paying customers. Such businesses often maintain a minimum amount of coins in their cash registers, with a greater amount secured elsewhere, often in a safe. In the event of a robbery of the cash register, this method insures that the bulk of the money kept at a business is not taken.

A problem that frequently arises with this money handling method is that employees often run out of coins in their cash register. The employees must then get additional coins, frequently in the form of coin rolls, from the safe. Giving the employee full access to the business safe increases the business's susceptibility to robbery, since a robber could potentially force the employee to open the safe and steal the contents.

Therefore, it would be advantageous for businesses to maintain their excess storage of coin rolls in a safe that allows employees access to the coin rolls, while not giving them full access in the event of a robbery. It is anticipated that business users would prefer the convenience of a simple coin roll dispenser, with the increased security of a safe.

SUMMARY OF THE INVENTION

It would be desirable to be able to modify a standard safe door to include a coin roll dispensing mechanism that gives users access to the coin rolls without giving them full access to the safe. It would also be desirable to be able to use the pre-existing bolt works and safe door opening handle provided on such safe doors. It would also be desirable to provide an electronic entry device to gain access to the coin rolls and to replace the manipulative portions of the mechanical lock.

It is therefore a primary object of the present invention to provide a coin roll dispensing mechanism for a conventional safe door. It is also an object of the present invention to provide such a coin roll dispensing mechanism wherein an electronic keypad entry device may be employed to gain access to the coin rolls and to unlock the safe door. It is still further an object of the present invention to provide a mechanism as in the foregoing objects wherein the operation of the mechanism is restricted until after the code has been entered, the mechanism then being freed to be manipulated by the user to obtain a selected coin roll. It is still further an object of the present invention to provide an electronic safe door lock wherein movement of the door handle is precluded until after entry of a second code sequence, the handle then being freed to be manipulated by the user to open the door.

Generally stated, the present invention includes the provision of a dispensing means for selectively distributing individual coin rolls, a securing means for preventing operation of the dispensing means until after entry of the first code sequence, and a first electrically operated means to disengage the securing means. Additionally, a manipulation means is provided for manipulating the door bolts between protracted and retracted positions relative the door, a locking means is provided to restrict operation of the manipulation means, and a second electrically operated means is provided for disengaging the locking means and enabling manipulation of the door bolts.

More specifically, the dispensing means of the present invention includes a coin roll magazine having a plurality of coin roll reservoirs and a rotating cylinder to manipulate coin rolls from within the reservoirs, a plurality of selection apertures to select a specific denomination of coin roll a plurality of shafts attached to each of the rotating cylinders, and a movable knob to engage the shafts. The securing means has a plurality of electrically operated solenoids to normally restrict rotation of the cylinders. The first electrically operated means produces a first code responsive signal to disengage the securing means.

More specifically, the manipulation means has a movable retraction plate, a rotation plate that cooperates with the door handle, a plurality of guide paths to guide manipulation of the retraction plate and a lock aperture engageable by an electrically retractable bolt. The second electrically operated means has a second electronic combination entry device for manual entry of a second coded sequence and an internal circuit board.

A more complete understanding of the coin dispensing mechanism of the present invention will be afforded to those skilled in the art, as well as a realization of additional advantages and objects thereof, by a consideration of the following detailed description of a preferred exemplary embodiment. Reference will be made to the appended sheets of drawings which will be first described briefly.

DESCRIPTION OF THE DRAWINGS

FIG. 5 is an enlarged sectional view showing the exemplary dispensing means in the normally secured position, as revealed by the section 5—5 taken in FIG. 4;

FIG. 6 is an enlarged sectional view showing the exemplary securing means in the normally secured position, as revealed by the section 6—6 taken in FIG. 4;

FIG. 7 is an enlarged detail view as in FIG. 4, showing the exemplary dispensing means in the enabled position;

FIG. 8 is an enlarged sectional view as in FIG. 5, showing the securing means in the enabled position;

FIG. 9 is an enlarged sectional view as in FIG. 6, showing the dispensing means in the enabled position.

DETAILED DESCRIPTION OF A PREFERRED EXEMPLARY EMBODIMENT

Figure 1:
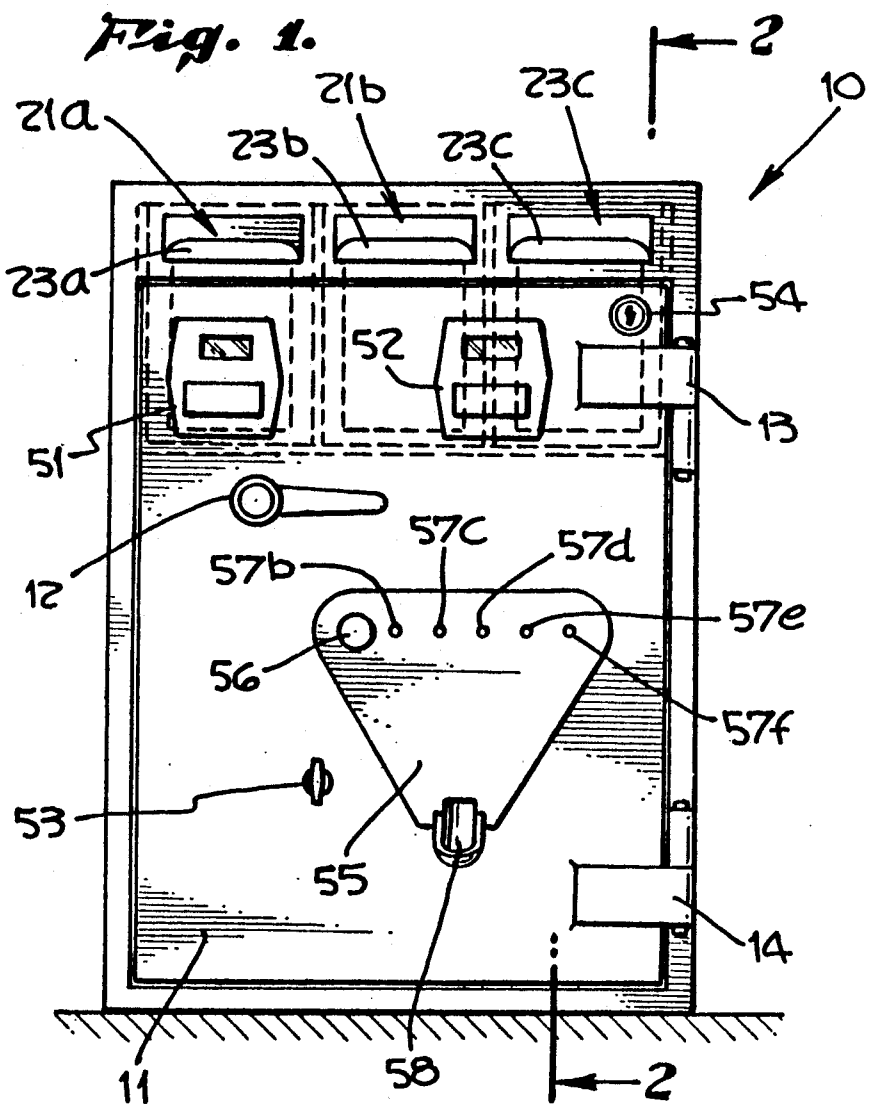
FIG. 1 is a front view of an exemplary safe door installation of a preferred exemplary embodiment of the coin roll dispensing mechanism of the present invention.

Referring to FIG. 1, a preferred exemplary embodiment of a coin roll dispensing mechanism for use in dispensing coin rolls through a safe door in accordance with the present invention is illustrated in association with a safe 10 having an otherwise standard door 1 attached by hinges 13 and 14, and having handle 12 to operate the bolt works as hereinafter described.

Mounted on the exterior of door are the exposed portions of the exemplary coin roll dispensing mechanism. A generally triangular face plate 55 for the coin roll dispensing mechanism is provided, and is mounted flush to door Il. A series of selection apertures 57*a*, 57*b*, 57*c*, 57*d*, 57*e* and 57*f* (57*a* not shown) penetrate door 11 and are exposed through corresponding openings in face plate 55. At the bottom of face plate 55, a delivery chute 58 protrudes through the door 11. The delivery chute 58 is sized to produce a coin roll, the chute being generally semicircular in shape and angled downward, so that a selected coin roll can slide along the chute and be delivered from within the safe 10 to a user. It is anticipated that the face plate 55 be provided with decorative graphic printing, identifying the denomination of coins available to the user. Such a face plate can be easily modified to feature coin denominations from a variety of countries, making the coin dispensing mechanism universally usable.

Figure 2:
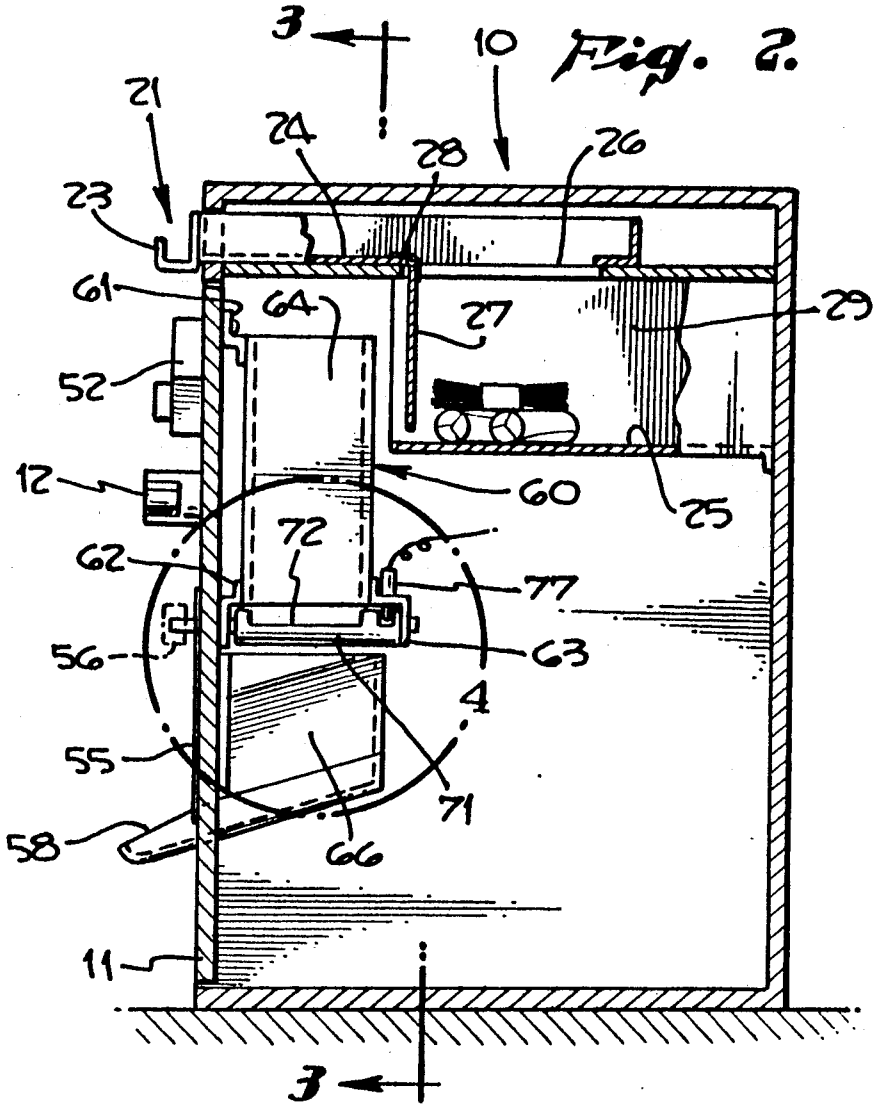
FIG. 2 is a partial side view of the interior of the exemplary safe cabinet showing the coin roll dispensing mechanism, as revealed by the section 2—2 taken in FIG. 1.

Associated with each selection aperture 57 is a shaft (not shown As best seen in FIGS. 1 and 2, the shaft associated with selection aperture 57*a* is occupied by knob 56. Knob 56 is rotatable, and is selectively movable to individually engage the shaft associated with each selection aperture, as determined by the user. As will be explained hereinafter, the knob is used to select a coin roll for dispensing from within the safe.

Figure 3:
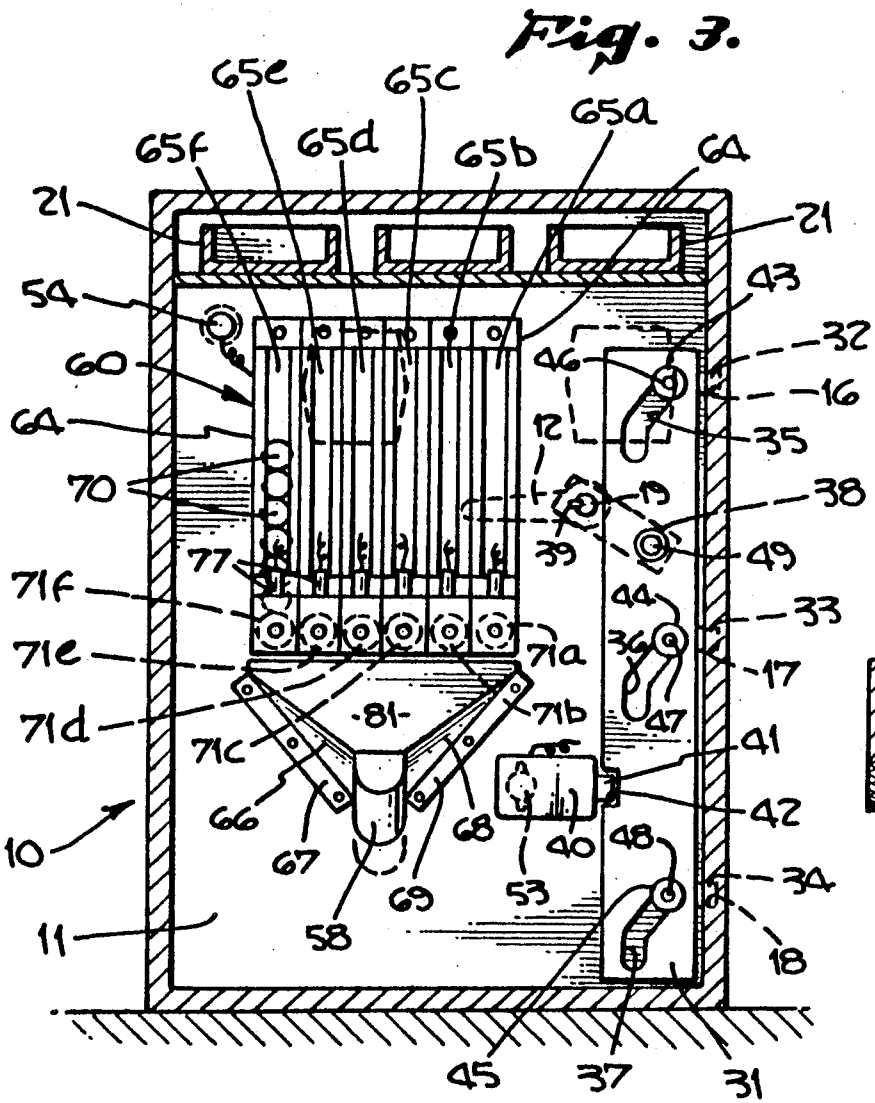
FIG. 3 is a sectional view of the interior of the exemplary safe door with the bolt works in the door locked position, showing the coin roll reservoirs, as revealed by the section 3—3 taken in FIG. 2.

Referring now to FIG. 2, an exemplary coin roll dispensing means is provided for selectively distributing individual coin rolls from within the safe to the user, and includes the provision of a coin magazine, shown generally at 60, a pair of guide ramps 66 and 68, a delivery chute 58, and the hereinbefore described knob 56. The coin magazine 60 is enclosed within a housing 64 and is secured to the safe door 11 at the top by upper mounting bracket 61, and at the bottom by lower mounting bracket 62. A rear mounting bracket 63 is affixed to the back of the magazine housing 64, as will be further described hereinbelow. As best seen in FIG. 3, magazine 60 is comprised of a series of coin roll reservoirs 65*a*, 65*b*, 65*c*, 65*d*, 65*e* and 65*f*, and rotatable cylinders 71*a*, 71*b*, 71*c*, 71*d*, 71*e* and 71*f*. For reasons of convenience, this specification will simply describe the function of a single coin reservoir 65 and cylinder 71, as it is representative of the function of the entire mechanism.

Each of the reservoirs 65 are rectangularly shaped and adjacently mounted, the reservoirs 65 being sized to hold a supply of coin rolls 70 stacked vertically within the reservoirs. In the preferred embodiment of the present invention, each of the reservoirs 65 would hold a distinct denomination of coin roll. At the bottom of each reservoir 65, rotatable cylinders 71 are provided, the axis of each being in linear alignment with the coin rolls 70 stored in the reservoir 65 above. The cylinders 71 rotate upon a forward axle 73 and a rear axle 74. Forward axle 73 penetrates door 11 through forward bushing 59, and exits through an associated selection aperture 57, where it provides the shaft to be affixed by the user to knob 56, as described hereinabove. Rear axle 74 penetrates through rear bushing 75 and rear mounting bracket 63.

Figure 4:
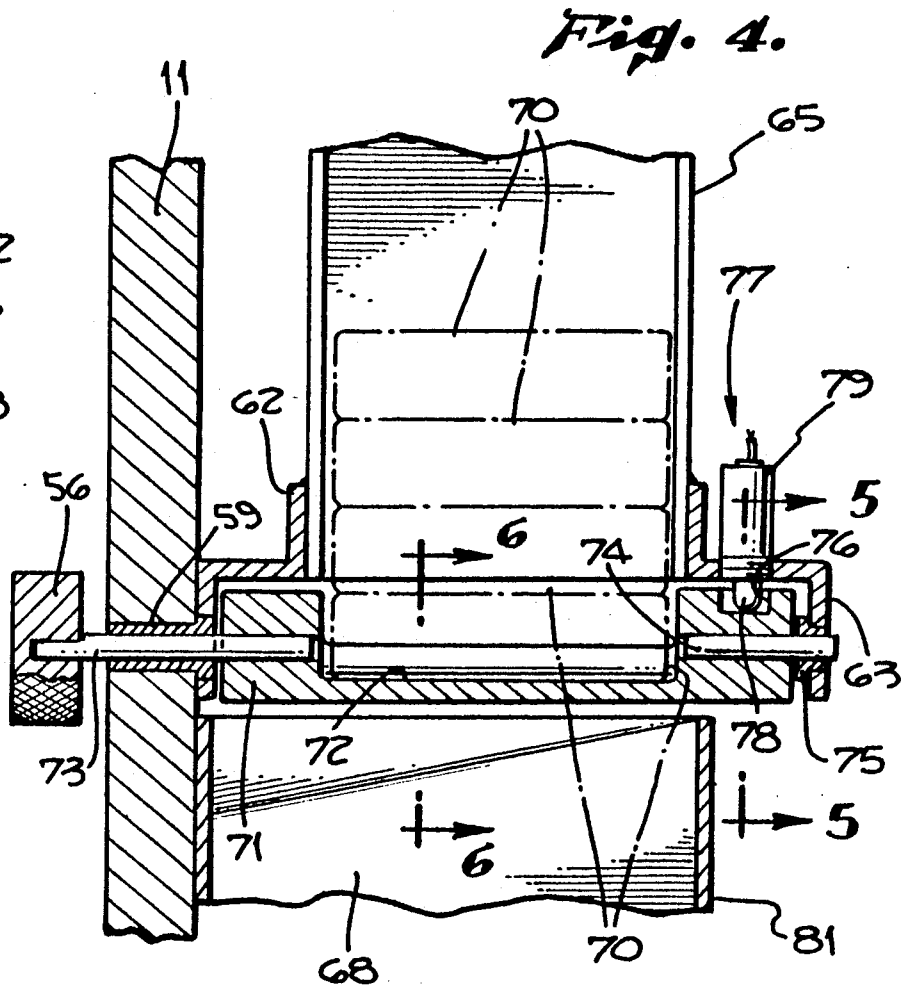
FIG. 4 is an enlarged detail view, taken from FIG. 2, showing the coin roll dispensing mechanism in the normally secured position.

The cylinders 71 each have an elongated cavity 72 as seen in FIGS. 4 and 7. Normally, the cylinder 71 would be positioned such that the cavity 72 faces upward into the reservoir 65. FIGS. 4 and 6 show the cylinder 71 in the normally upward facing position. Each cavity 72 is sized to hold a coin roll 70; the lowermost of the coin rolls in the reservoir 65 above would drop into and be completely contained within the cavity. Rotation of the knob 56 by the user in association with a selected shaft in either a clockwise or counter-clockwise direction causes similar rotation of the selected cylinder 71. After the knob 56 has been rotated a full 180 degrees, a selected coin roll 70 is transferred out from within the reservoir 65. FIGS. 7 and 9 show the cylinder 71 in the fully rotated position.

Mounted below the magazine 71 are a combination of plates which guide the selected coin roll 70 to the user. A pair of guide ramps 66 and 68 are provided, along with a ramp enclosure plate 81. The guide ramps 66 and 68 are generally triangle shaped, with one edge mounting to the interior surface of the door 11 by use of mounting flanges 67 and 69. The second edges of the guide ramps 66 and 68 join with the enclosure plate 81, forming a triangular box or funnel below the magazine 60. The third and lowermost edges of the guide ramps join with the delivery chute 58, which leads through door 11, as described hereinabove. A coin roll 70 which is removed from any of the coin reservoirs 65 via the cylinder 71 will drop down onto one of the guide ramps 66 and 68 and be guided to the delivery chute 58, and delivered through the door 11 to the user.

As also shown in FIGS. 4 and 7, a securing means is provided for preventing operation of the above described dispensing means. The securing means is comprised of a plurality of electrically operated solenoids, shown generally at 77, which normally restrict the rotation of the cylinders 71, and a plurality of arcuate limit channels 76. Each of the solenoids 77 have a body portion 79 and an armature portion 78. The solenoids 77 are mounted on rear mounting bracket 63 with the armature portions 78 facing downward. The limit channels 76 are positioned at the rearmost end of the cylinder and are disposed circumferentially along the outer surface of the cylinder 71, and traverse a limited arc of the cylinder's circumference. The armature portions 78 provide a plurality of posts, each being normally positioned to engage each of the limit channels 76, and limit rotation of the cylinders 71 to the limited arcuate range of the limit channels. FIG. 5 shows the post in position within limit channel 76. With the posts normally positioned within the limit channels 76, the cylinders 71 can not be rotated, and coin rolls 70 can not be removed from the respective reservoirs. Once the solenoids 77 have been energized, the posts retract enabling full rotation of the cylinders 71. FIG. 8 shows the post in the retracted position.

To allow the user to get access to the coin roll reservoirs 65, a first electrically operated means is provided for producing a first code responsive signal to disengage the securing means and enable manipulation of each of the cylinders 71 of the dispensing means. The first electrically operated means comprises a first electronic combination entry device 51 for manual entry of a first coded sequence and a first circuit board (not shown) associated with the first entry device for generating the first code responsive signal. The entry device 51 is mounted to the front of the safe door 11, as best seen in FIG. 1. The code responsive signal is transferred by known electrical means to the solenoids 77, causing the armature portions 78 to retract, allowing the user to rotate the knob 56 as described hereinabove.

It is anticipated that a user desiring a coin roll will first move knob 56 to the selection aperture 57 associated with the desired denomination of coin. The user will then enter a predetermined code into the first entry device 51, whereupon the securing means will disengage, allowing the user to rotate the knob 56 one half turn or 180 degrees in either a clockwise or counterclockwise direction, further causing the desired coin roll 70 to be delivered to the delivery chute 58.

It is further anticipated that the first code responsive signal be of a limited time duration, so that a user would only have enough time to rotate the knob 56 once. To obtain a second coin roll, the user must re-enter the predetermined code into the first entry device 51. It is still further anticipated that the aforementioned circuit board contain a timing circuit of known electrical means to allow the generation of only one of the described first code responsive signals in a predetermined minimum period of time. This timing circuit would allow the user to only obtain one coin roll in the specified period; the user would have to wait until the period expired before obtaining a second coin roll. In the preferred embodiment of the present invention, the minimum period of time would be five minutes.

In an alternative embodiment of the present invention, the first electrically operated means would comprise a first manual key switch 54 along with the first electronic combination entry device 51. The key switch 54 is mounted to the front of the safe door 11, as best seen in FIG. 1. In this embodiment, either manipulation of the proper key in the key switch 54, or entry of the first coded sequence into entry device 51 will generate the first code responsive signal.

As it will be necessary for the user to periodically unlock the entire safe door in order to reload the coin reservoirs 65 or to add or remove money or other items from the safe, an exemplary locking means and bolt manipulation means is provided. Referring now back to FIG. 3, the interior of door 11 has a plurality of safe door bolts, exemplarily shown as upper door bolt 32, center door bolt 33, and lower door bolt 34. The manipulation means is used to manipulate the door bolts between protracted and retracted positions relative the door 11 in response to rotational operation of handle 12, and includes the provision of retraction plate 31 and rotation plate 38. The retraction plate 31 is rectangular and vertically manipulatable. Three generally L-shaped guide ways 35, 36 and 37 are cut into the interior portion of the retraction plate 31 and correspond to the three door bolts 32, 33 and 34. Rotation plate 38 links door handle 12 with retraction plate 31, and is secured to handle shaft 19 by use of handle shaft pin 39, and to retraction plate 38 by use of pivot shaft 49.

Door bolts 32, 33 and 34 are attached to guide wheels 43, 44 and 45, respectively, via guide shafts 46, 47 and 48, respectively. The door bolts 32, 33 and 34 are relatively positioned to engage bolt receptacles 16, 17 and 18 located in safe door jamb 15.

Manipulation of door handle 12 causes rotation of handle shaft 19 and consequent rotation of rotation plate 38, which translates to vertical motion of retraction plate 31. As retraction plate 31 moves upward, guide wheels 43, 44 and 45 travel along guide ways 35, 36 and 37, which retracts bolts 32, 33 and 34 from within their respective receptacles. However, vertical movement of retraction plate 31 as described hereinbefore is prevented by the use of the locking means, which normally restricts operation of the manipulation means, and has an electrically retractable bolt normally biased in a position impeding operation of the manipulation means.

The exemplary locking means comprises electric lock 40 and lock aperture 42. Electric lock 40 has a retractable bolt 41, which retracts upon electrical transfer of a second code responsive signal. Lock aperture 42 is provided on the interior surface of retraction plate 31, and is positioned to mate with the retractable bolt 41 when retraction plate 31 is in the bolt protracted position.

Within the present invention, a second electrically operated means is provided for producing the second code responsive signal to disengage the locking means and enable manipulation of the door bolts. The second electrically operated means comprises a second electronic combination entry device 52 for manual entry of a second predetermined coded sequence and a circuit board (not shown) associated with the second entry device for generating the second code responsive signal. Second entry device 52 is mounted to the front of door 11, as best seen in FIG. 1.

Upon entry of the second predetermined code sequence into the second entry device 52, the internal circuit board generates the second code responsive signal which is transmitted by known electrical means to the electric lock 40, causing retractable bolt 41 to retract against its internal bias. The user is then free to manipulate door handle 12, to retract bolts 32, 33 and 34, and consequently open door 11.

In an alternative embodiment of the present invention, a second door key switch 53 is provided, as shown in FIG. 1. Second key switch 53 is electrically connected to the circuit board within second entry device 52, so that manual manipulation of the key switch will also generate the second code responsive signal to the electric lock 40. In this alternative embodiment, either manual entry of the predetermined code sequence into the second code entry device 52 or manipulation of the second key switch 53 will enable the user to unlock safe 10. It is also anticipated that the second manual key switch 53 comprises a round key of the type disclosed in U.S. Pat. No. 4,418,555, entitled "Cylinder Type Lock and Key."

In another alternative embodiment of the present invention, a secure depositing means is provided for inserting items through the safe door 11 and for preventing unauthorized removal of items without first opening the door. The secure depositing means comprises a plurality of drawers accessible from the exterior of the safe, and a plurality of shelves associated with the drawers.

The exemplary drawers insert directly into the safe door 11, as shown generally at **21*a*, 21*b*, and 21*c* of FIG. 1, and are manually slidable between an open and a closed position. Each of the drawers have an integrally formed handle, exemplarily shown as 23*a*, 23*b* and 23*c*, respectively. The drawers each have an interior bottom panel 24 and a deflecting bottom panel 27 which attaches to the bottom panel 24 by the use of a spring biased hinge 28**.

Below each of the drawers, there are associated shelves 25, as best seen in FIG. 2. Each shelf 25 provides an open space 29 for the storage of cash, documents, coin rolls or other materials, but are only accessible to the user after the safe door 11 has been opened. However, with the drawer 21 returned to the fully closed position, the deflecting panel 27 deflects downward through a conduit 26 formed between the drawer 21 and the shelf 25. It is anticipated that the user would place items into the drawer 21 with the intention that upon manipulation of the drawer to the fully closed position, the deflecting panel 27 would deflect downward and the deposited items would be transferred via the conduit to the shelf 25. It is also anticipated that the height of the drawer 21 be sufficiently narrow, so that an unauthorized user could not improperly gain access or otherwise remove the contents of the shelf 25 via the conduit 26.

Having thus described a preferred exemplary embodiment of a coin roll dispensing mechanism for use in dispensing coin rolls from a safe in accordance with the present invention, it should now be apparent to those skilled in the art that the aforestated objects and advantages for the within mechanism have been achieved. It should also be appreciated by those skilled in the art that various modifications, adaptations and alternative embodiments thereof may be made within the scope and spirit of the present invention which is defined by the following claims.

We claim:

1. A coin roll dispensing machine for use in dispensing coin rolls through a safe door, comprising:

a dispensing means for selectively distributing individual ones of said coin rolls, said dispensing means having a coin magazine, a pair of guide ramps and associated delivery chute below said magazine, said magazine comprising a plurality of coin reservoirs, a plurality of rotatable cylinders, a plurality of selection apertures, and a plurality of shafts axially linked to said cylinders and accessible via said selection apertures, said coin rolls being stored in each of said reservoirs, each of said cylinders positioned at the bottom of each of said reservoirs respectively and having a cavity sized to accept the lowermost of said coin rolls;

a securing means for preventing operation of said dispensing means, said securing means having a plurality of electrically operated solenoids to normally restrict rotation of each of said plurality of cylinders; and a first electrically operated means for producing a first code responsive signal to disengage said securing means and enable a selected cylinder to be manually rotated, said first electrically operated means comprising a first electronic combination entry device for manual entry of a first coded sequence and a first circuit board associated with said first entry device electrically connected to said solenoids;

wherein, upon disengagement of said securing means, direct manual rotation of a selected one of said shafts causes corresponding rotation of the cylinder associated with said selected shaft, allowing a lowermost one of coin rolls in said cylinder to be removed from said reservoir and guided to said delivery chute by said guide ramps.

2. The coin roll dispensing mechanism of claim 1, wherein:

each of said cylinders have an arcuate limit channel circumferentially disposed along the outer surface of said cylinder; and said securing means further comprises a plurality of posts, each individual one of said posts being normally positioned to engage a respective one of said limit channels, limiting rotation of said cylinders to the limit channels arcuate range.

3. The coin roll dispensing mechanism of claim 2, wherein:

said first code responsive signal is of limited time duration and a subsequent one of said first code responsive signals can only be generated after the expiration of a minimum periods of time.

4. The coin roll dispensing mechanism of claim 3, wherein:

each of said plurality of solenoids further comprises a body and an armature portion normally biased outwardly of said body, said armatures providing said posts.

5. The coin roll dispensing mechanism of claim 4, wherein each of said reservoirs holds a supply of said coin rolls of a unique denomination.

6. The coin roll dispensing mechanism of claim 5, wherein said minimum period of time is at least five minutes.

7. A combination safe and coil roll dispenser for use is dispensing coin rolls through a door of the safe, comprising:

a dispensing means for selectively distributing individual ones of said coin rolls, said dispensing means having a coin magazine, a pair of guide ramps and associated delivery chute below said magazine, said magazine comprising a plurality of coin reservoirs, a plurality of rotatable cylinders, a plurality of selection apertures, and a plurality of shafts axially linked to said cylinders and accessible via said selection apertures, said coin rolls being stored in each of said reservoirs, each of said cylinders positioned at the bottom of each of said reservoirs respectively and having a cavity sized to accept the lowermost of said coin rolls;

a securing means for preventing operation of said dispensing means, said securing means having a plurality of electrically operated solenoids to normally restrict rotation of each of said plurality of cylinders; and a first electrically operated means for disengaging said securing means and enabling a selected cylinder to be manually rotated, said first electrically operated means comprising a first electronic combination entry device for manual entry of a first coded sequence and a first circuit board associated with said first entry device electrically connected to said solenoids;

whereby, upon disengagement of said securing means, direct manual rotation of a selected one of said shafts causes corresponding rotation of the cylinder associated with said selected shaft, allowing a lowermost one of coin rolls in said cylinder to be removed from said reservoir and guided to said delivery chute by said guide ramps; and wherein said safe door further comprises:

a door handle, a plurality of safe door bolts and means for manipulating said bolts between protracted and retracted positions relative said door in response to rotation operation of said handle;

a locking means for normally restricting operation of said manipulation means, said locking means having an electrically retractable bolt normally biased in a position impeding operation of said manipulation means; and a second electrically operated means for producing a second code responsive signal to disengage said locking means and thereby enable manipulation of said door bolts.

8. The coin roll dispensing mechanism of claim 7, wherein:

said bolt manipulation means comprises a vertically movable retraction plate having a plurality of guide paths for guiding manipulation of said bolts between protracted and retracted positions, a rotation plate associated with said door handle for translating rotational movement of said door handle to vertical movement of said retraction plate and a lock aperture integral to said retraction plate for being engaged by said electrically retractable bolt.

9. The coin roll dispensing mechanism of claim 8, wherein said second electrically operated means comprises a second electronic combination entry device for manual entry of a second coded sequence and a circuit board associated with said second entry device for generating said second code responsive signal, said second code responsive signal causing retraction of said electrically retractable bolt.

10. A coin roll dispensing mechanism for use in dispensing con rolls through a safe door, comprising:

a dispensing means for selectively distributing individual ones of said coin rolls, said dispensing means having a coin magazine, a pair of guide ramps and associated delivery chute below said magazine, said magazine comprising a plurality of coin reservoirs, a plurality of rotatable cylinders, a plurality of selection apertures, and a plurality of shafts axially linked to said cylinders and accessible via said selection apertures, said coin rolls being stored in each of said reservoirs, each of said cylinders positioned at the bottom of each of said reservoirs respectively and having a cavity sized to accept the lowermost of said coin rolls, each of said cylinders further having an arcuate limit channel circumferentially disposed along the outer surface of said cylinder;

a securing means for preventing operation of said dispensing means, said securing means having a plurality of electrically operated solenoids to normally restrict rotation of each of said plurality of cylinders and a plurality of posts each individual one of said posts normally positioned to engage a respective one of said limit channels, thereby limiting rotation of said cylinders to the limit channels arcuate range; and a first electrically operated means for disengaging said securing means and enabling a selected cylinder to be manually rotated, said first electrically operated means comprises a first electronic combination entry device for manual entry of a first coded sequence, a first manual key switch and a first circuit board associated with said first entry device, said first electrically operated means generating a first code responsive signal either after entry of said first coded sequence or after manipulation of said first key switch; and said first code responsive signal is of limited time duration and a subsequent one of said first code responsive signals can only be generated after the expiration of a minimum period of time;

whereby, upon disengagement of said securing means, direct manual rotation of a selected one of said shafts causes corresponding rotation of the cylinder associated with said selected shaft, allowing a lowermost one of coin rolls in said cylinder to be removed from said reservoir and guided to said delivery chute by said guide ramps.

11. The coin roll dispensing mechanism of claim 8, wherein:

said second electrically operated means comprises a second electronic combination entry device for manual entry of a second coded sequence, a second manual key switch and a circuit board associated with said second entry device and said second key switch for generating said second code responsive signal either after entry of said second coded sequence or after manipulation of said second key switch.

12. The coin roll dispensing mechanism of claim 10 wherein said second key switch comprises a round key.

13. The coin roll dispensing mechanism of claim 7, wherein said safe door further comprises a secure depositing means for inserting items through said safe door and for preventing unauthorized removal of said items without first opening said safe door.

14. The coin roll dispensing mechanism of claim 13, wherein said secure depositing means further comprises:

a plurality of drawers accessible from the exterior of said safe door, each of said drawers being slidable between an open and a closed position, and each having an associated deflecting bottom panel;

a plurality of shelves associated with said drawers, each of said shelves being accessible only after opening said safe door, said deflecting panels providing a conduit between said drawers and said shelves upon return of said drawers to said closed position;

whereby, manipulation of each of said drawers from said open to said closed position causes said associated deflecting panel to deflect, further causing said items deposited into each of said drawers while in sad open position to be transferred via said conduit to said shelves.

15. The coin roll dispensing mechanism of claim 13, wherein said delivery chute has an opening accessible to the user, and said guide ramps are positioned to manipulate said coin roll onto said delivery chute.

16. The coin roll dispensing mechanism of claim 15, wherein each of said reservoirs holds a supply of said coin rolls of a unique denomination.

* * * * *